US012433407B1

(12) United States Patent
Zhang

(10) Patent No.: US 12,433,407 B1
(45) Date of Patent: Oct. 7, 2025

(54) CHILDREN'S SWIVEL CHAIR

(71) Applicant: Jinhua Gica Baby Products Co., Ltd., Zhejiang (CN)

(72) Inventor: Xiaoyu Zhang, Zhejiang (CN)

(73) Assignee: Jinhua Gica Baby Products Co., Ltd., Zhejiang (CN)

( * ) Notice: Subject to any disclaimer, the term of this patent is extended or adjusted under 35 U.S.C. 154(b) by 0 days.

(21) Appl. No.: 19/060,756

(22) Filed: Feb. 23, 2025

(51) Int. Cl.
*A47C 3/18* (2006.01)
*A47D 1/00* (2006.01)

(52) U.S. Cl.
CPC ..... *A47C 3/18* (2013.01); *A47D 1/006* (2013.01)

(58) Field of Classification Search
CPC .. A47C 3/18; A47C 15/00; A47C 3/12; A47D 1/006; A47D 1/002
See application file for complete search history.

(56) References Cited

U.S. PATENT DOCUMENTS

| | | | | | |
|---|---|---|---|---|---|
| 3,964,790 | A * | 6/1976 | Bergeron | A47C 3/04 | 297/118 |
| 9,629,465 | B2 * | 4/2017 | Williams | A47C 3/18 | |
| 2004/0160105 | A1 * | 8/2004 | Tseng | A47C 4/02 | 297/344.21 |
| 2005/0104426 | A1 * | 5/2005 | Yu | A47C 15/00 | 297/240 |
| 2011/0304183 | A1 * | 12/2011 | van Hekken | A47C 7/44 | 297/354.1 |
| 2012/0038194 | A1 * | 2/2012 | Tseng | A47C 3/18 | 297/344.21 |
| 2019/0298065 | A1 * | 10/2019 | Smiley | A47C 3/18 | |

FOREIGN PATENT DOCUMENTS

| | | | | |
|---|---|---|---|---|
| CN | 105996508 | A * | 10/2016 | |
| CN | 107280301 | A * | 10/2017 | |
| CN | 108713916 | A * | 10/2018 | |
| CN | 111588209 | A * | 8/2020 | |
| CN | 219479602 | U * | 8/2023 | A47B 91/005 |
| DE | 202008002651 | U1 * | 9/2008 | A47B 13/023 |
| FR | 3006870 | A1 * | 12/2014 | A47C 11/005 |
| GB | 2474349 | A * | 4/2011 | A47C 11/00 |
| KR | 20190132799 | A * | 8/2023 | |
| WO | WO-9205725 | A1 * | 4/1992 | |

* cited by examiner

*Primary Examiner* — Timothy J Brindley
(74) *Attorney, Agent, or Firm* — Hawaii Patent Services; Nathaniel K. Fedde; Kenton N. Fedde

(57) ABSTRACT

Disclosed is a children's swivel chair, including a chassis assembly. The chassis assembly includes a plurality of padding plates that are spliced together, the plurality of padding plates are spliced together to form a chassis structure concave in a middle, a bottom of the chassis structure is further provided with a support seat, and the support seat rotationally supports the chassis structure on a carrier. The chassis assembly of the children's swivel chair in this example is formed by splicing a plurality of structurally identical padding plates, and during transport or storage, each of the padding plates can be disassembled to reduce an overall volume and occupied space, thereby facilitating transport and storage. Further, a base assembly of the children's swivel chair is designed to have a detachable structure, which further enhances convenience of storage and transport.

10 Claims, 6 Drawing Sheets

CHILDREN'S SWIVEL CHAIR

TECHNICAL FIELD

The present disclosure relates to the technical field of children's toys and apparatuses, and in particular to a children's swivel chair detachable and conveniently storable.

BACKGROUND

Children's swivel chairs with unique designs and rich functions have become an indispensable part of modern family life. The children's swivel chairs not only meet daily seating needs of children but also provide comprehensive protection and support for their growth through scientifically reasonable designs. A seat cushion and a base of a children's swivel chair of the prior art are usually integrated, and the seat cushion and the base have a certain size, occupy large space and cannot be disassembled, thereby making transport and storage inconvenient.

SUMMARY

In order to overcome the defects in the prior art, an objective of the present disclosure is to provide a children's swivel chair, so as to solve the technical problems of children's swivel chairs of the prior art including inconvenient transport and storage due to fixed structures and large space occupied.

In order to achieve the above objective, the present disclosure adopts a technical solution as follows:

In an example of the present disclosure, a children's swivel chair is provided, including a chassis assembly, and the chassis assembly includes a plurality of padding plates that are spliced together, the plurality of padding plates are spliced together to form a chassis structure concave in a middle, a bottom of the chassis structure is further provided with a support seat, and the support seat rotationally supports the chassis structure on a carrier.

In an example, the chassis assembly further includes a clamp, a clamp groove is formed at a bottom of the chassis structure close to an edge thereof, and the clamp is snap-fitted into the clamp groove.

In an example, a snap-fit slot and a snap-fit bump are arranged on edges of opposite outer sides of the padding plate respectively, a snap-fit portion is further arranged at an inner edge of the padding plate, and the snap-fit portion is snap-fitted with the support seat; and the adjacent padding plates are in inserted connection with the snap-fit bump through the snap-fit slot.

In an example, the snap-fit portion includes a plug-in portion and an annular groove that radially extend from an inner edge of the padding plate, the support seat is provided with a disc-like connecting portion, and the disc-like connecting portion is provided with a slot corresponding to the plug-in portion and an annular wall corresponding to the annular groove.

In an example, inner edges of the annular groove and the plug-in portion are parallel arc structures coaxially extending.

In an example, the support seat is further provided with a rotating shaft, and the rotating shaft is arranged parallel to an axis of the chassis structure.

In an example, the support seat has a conical structure, and the rotating shaft is connected to an axial position of the conical structure.

In an example, a stiffening rib is further arranged on a bottom surface of each of the padding plates.

In an example, the children's swivel chair further includes a base assembly connected to the support seat, the base assembly has a detachable structure, and the chassis assembly is rotatably connected to the base assembly.

In an example, the base assembly includes an annular seat and a support arm in bridge connection with the annular seat, both ends of the support arm are connected to the annular seat respectively, and the chassis assembly is rotatably connected to the support arm.

In an example, the support arm has an arch-shaped structure convex in a middle thereof.

In an example, the chassis assembly is rotatably connected to the base assembly in an inclined state.

In an example, the annular seat includes: a plurality of arc-shaped tubes, and connectors that are configured to connect the adjacent arc-shaped tubes.

In an example, each of the connectors is provided with a first connecting hole and a second connecting hole that are butt-jointed with the corresponding arc-shaped tube, the arc-shaped tube is further provided with a telescopic column, each of the connectors is provided with a cylindrical hole, and when the arc-shaped tube is inserted into the first connecting hole or the second connecting hole, the telescopic column penetrates through the cylindrical hole.

The chassis assembly of the children's swivel chair in this example is formed by splicing a plurality of structurally identical padding plates, and during transport or storage, each of the padding plates can be disassembled to reduce an overall volume and occupied space, thereby facilitating transport and storage. Further, the base assembly of the children's swivel chair is designed to have a detachable structure, which further enhances convenience of storage and transport.

The above description is merely a summary of the technical solution of the present disclosure. In order to have a clearer understanding of the technical means of the present disclosure, the content of the specification may be referred to for implementation. To make the above and other objectives, features and advantages of the present disclosure apparent and understandable, the following preferred examples are detailed as follows.

DETAILED DESCRIPTIONS OF THE EMBODIMENTS

Figure 1:
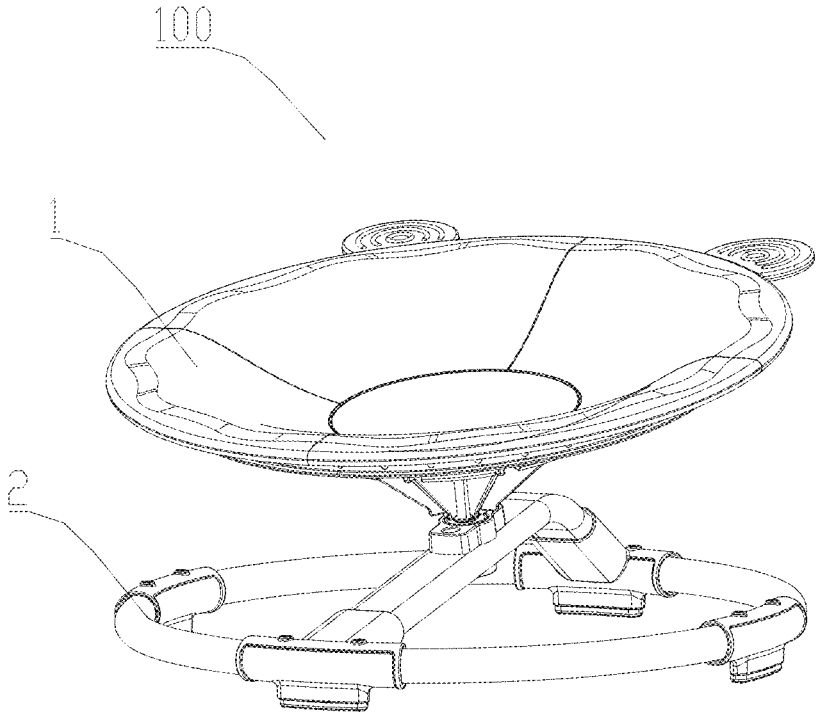
FIGS. 1 and 2 are schematic diagrams of different views of an overall structure of a children's swivel chair according to an example of the present disclosure.

In order to make objectives, technical solutions and advantages of the present disclosure clearer, the present disclosure will be described in further detail below with reference to the accompanying drawings and specific embodiments.

The technical solutions in the examples of the present disclosure will be clearly and completely described below in combination with the accompanying drawings in the examples of the present disclosure. Apparently, the examples described are merely some rather than all of the examples of the present disclosure. Based on the described examples of the present disclosure, all other examples acquired by those skilled in the art without making creative efforts fall within the protection scope of the present disclosure.

In the description of the present disclosure, it should be understood that the terms "center", "longitudinal", "lateral", "length", "width", "thickness", "upper", "lower", "front", "rear", "left", "right", "vertical", "horizontal", "top", "bottom", "inner", "outer", "clockwise", "counterclockwise", etc. indicate azimuthal or positional relations based on those shown in the accompanying drawings only for ease of description of the present disclosure and for simplicity of description, and are not intended to indicate or imply that the referenced device or element must have a particular orientation and be constructed and operative in a particular orientation, and thus may not be interpreted as a limitation on the present disclosure.

Furthermore, the terms "first" and "second" are merely for the purpose of description, and cannot be construed as indicating or implying relative importance or implicitly specifying the number of technical features indicated. Thus, a feature defined with "first" and "second" may explicitly or implicitly include one or more of the features. In the description of the present disclosure, "a plurality of" means two or more, unless expressly specified otherwise.

In the present disclosure, it should be noted that, unless otherwise explicitly specified and defined, the terms "mounting", "connecting", "connection", "fixing", etc. should be understood in a broad sense. For example, the connection may be a fixed connection, a detachable connection or an integral connection; may be a mechanical connection or an electrical connection; may be a direct connection or an indirect connection by using an intermediate medium; or may be intercommunication between two components, or an interactive relation between two elements. The specific meanings of the above terms in the present disclosure may be understood on a case-by-case basis for those skilled in the art.

In the present disclosure, unless otherwise expressly stated and defined, a first feature being "above" or "below" a second feature may include the first and second features being in direct contact or that the first and second features being not in direct contact but being in contact by means of additional features between the first and second features. In addition, the first feature being "over", "above" and "on the top of" the second feature includes that the first feature is over and above the second feature, or simply means that the level of the first feature is higher than that of the second feature. The first feature being "under", "below" and "at the bottom of" the second feature includes that the first feature is under and below the second feature, or simply means that the level of the first feature is lower than that of the second feature.

In the description of the present specification, the description of reference terms such as "one embodiment", "some embodiments", "example", "specific example" or "some examples" means that specific features, structures, materials or characteristics described in combination with the embodiment or example are included in at least one embodiment or example of the present disclosure. In the present description, the schematic description of the above terms should not be construed as necessarily referring to the same embodiment or example. Moreover, the specific features, structures, materials or characteristics described may be combined in a suitable manner in any one or more embodiments or examples.

Children's swivel chairs with unique designs and rich functions have become an indispensable part of modern family life. The children's swivel chairs not only meet daily seating needs of children but also provide comprehensive protection and support for their growth through scientifically reasonable designs. A seat cushion and a base of a children's swivel chair of the prior art are usually fixedly connected, and the seat cushion and the base have a certain size and occupy large space, thereby making transport and storage inconvenient. In view of the above situation, there is provided a detachable assembly-type children's swivel chair 100 in this example.

Figure 2:
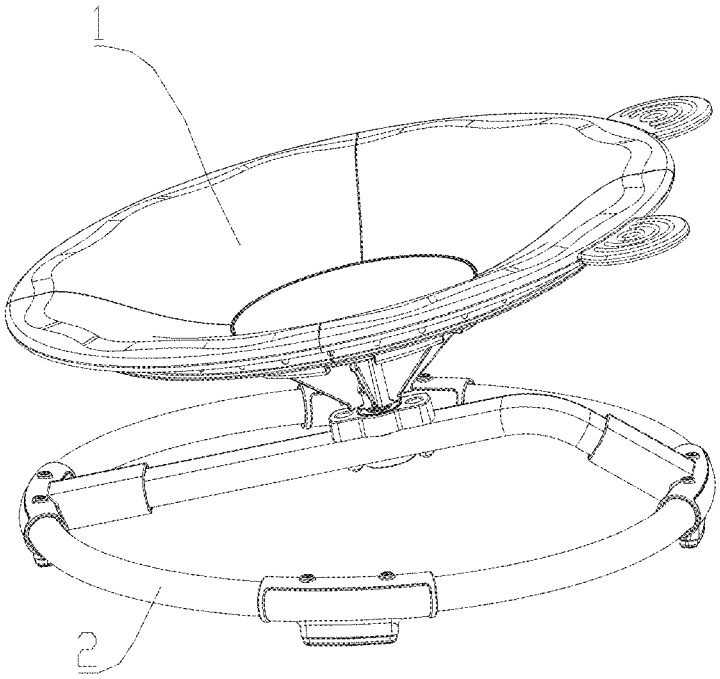
Figure 3:
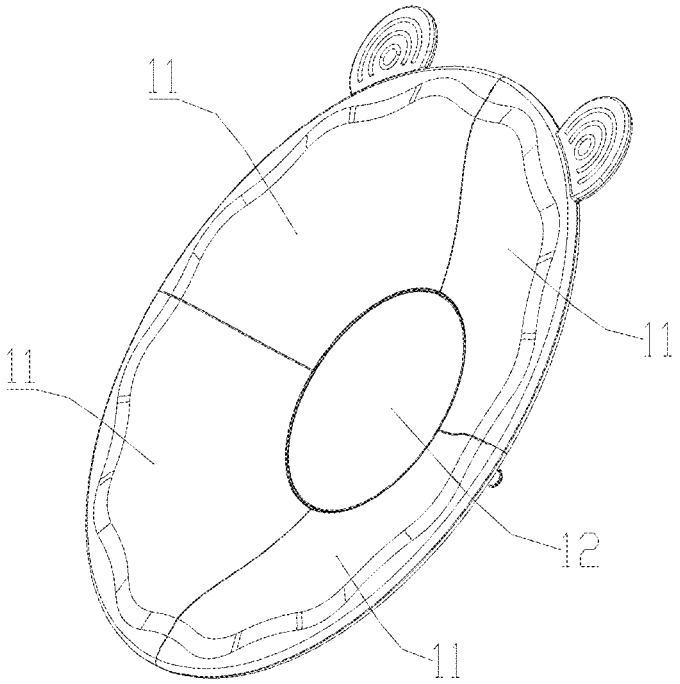
FIGS. 3 and 4 are structural schematic diagrams of different views of a chassis assembly of a children's swivel chair according to an example of the present disclosure.
Figure 4:
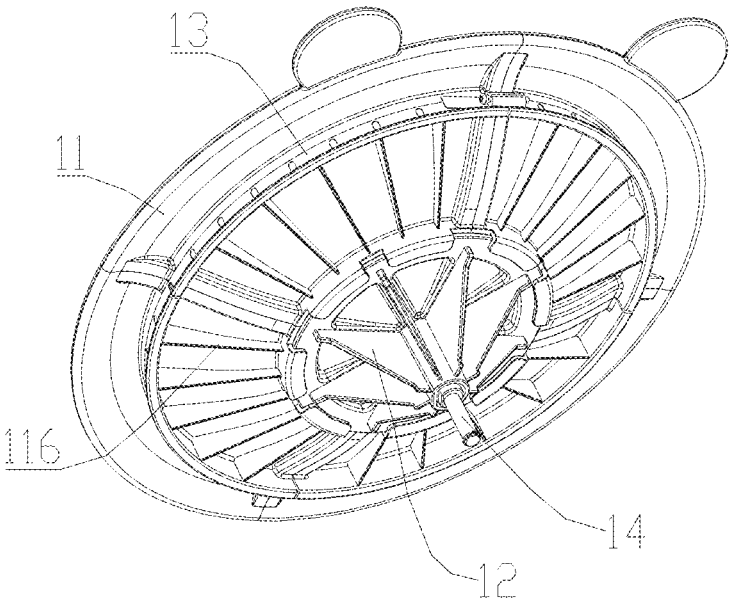
Figure 5:
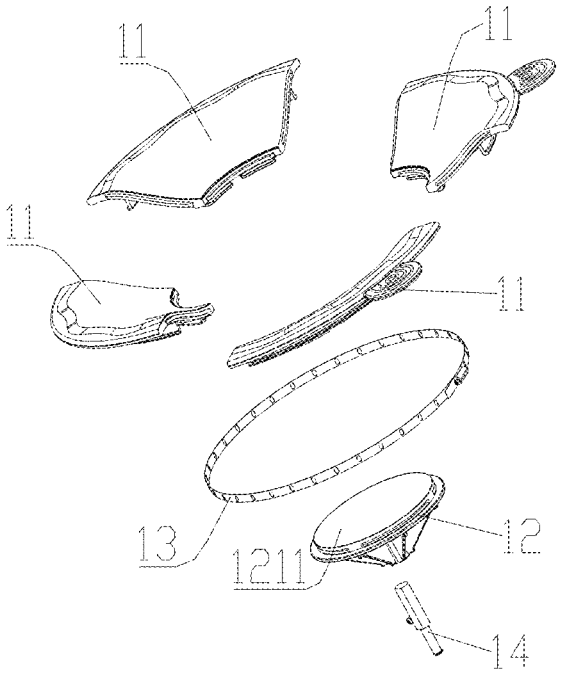
FIG. 5 is an exploded view of a chassis assembly of a children's swivel chair according to an example of the present disclosure.
Figure 6:
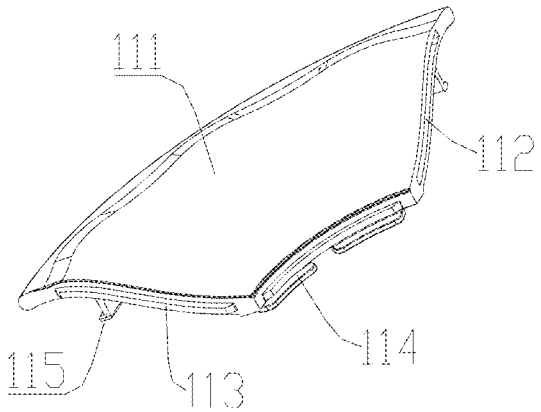
FIG. 6 is a structural schematic diagram of a padding plate of a children's swivel chair according to an example of the present disclosure.
Figure 7:
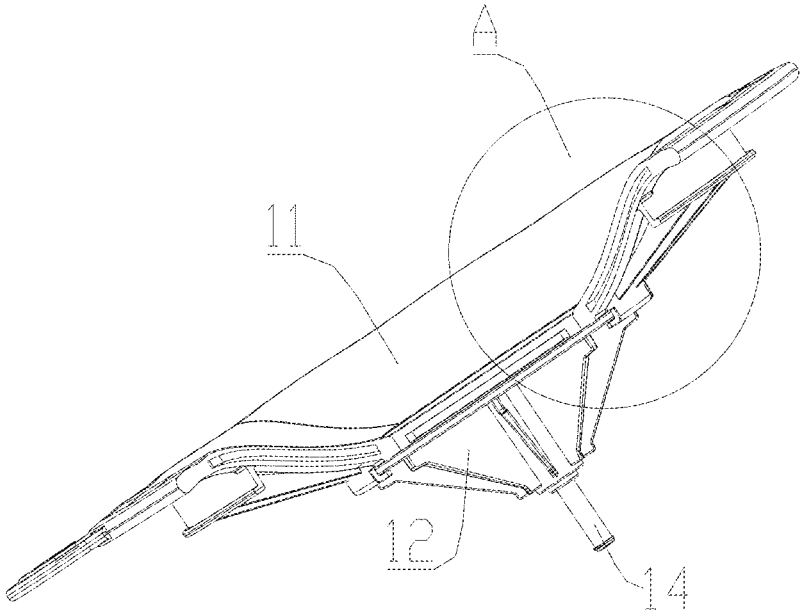
FIG. 7 is a structural schematic diagram of a chassis assembly of a children's swivel chair according to an example of the present disclosure where a padding plate is removed.
Figure 8:
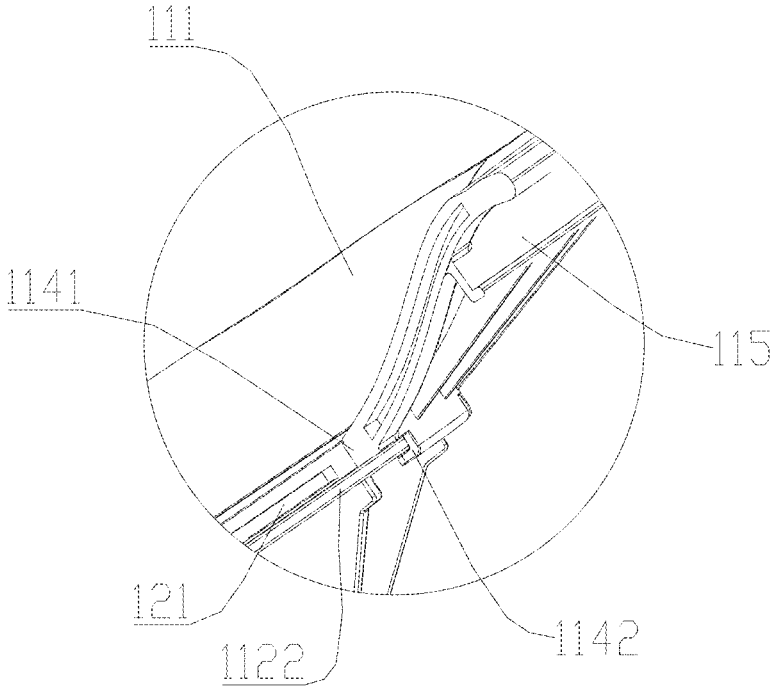
FIG. 8 is a schematic diagram of an enlarged structure of a part A shown in FIG. 7.
Figure 9:
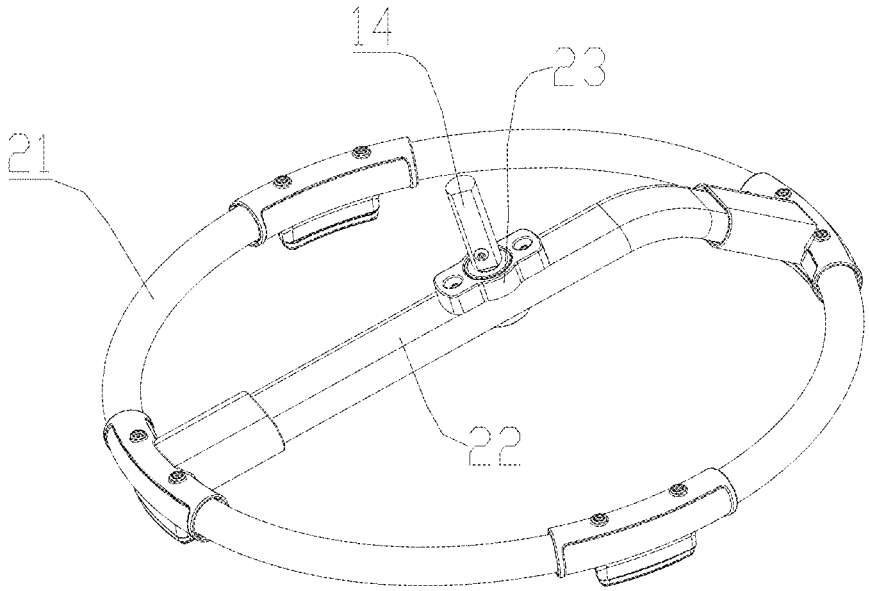
FIGS. 9 and 10 are structural schematic diagrams of different views of a base assembly of a children's swivel chair according to an example of the present disclosure.
Figure 10:
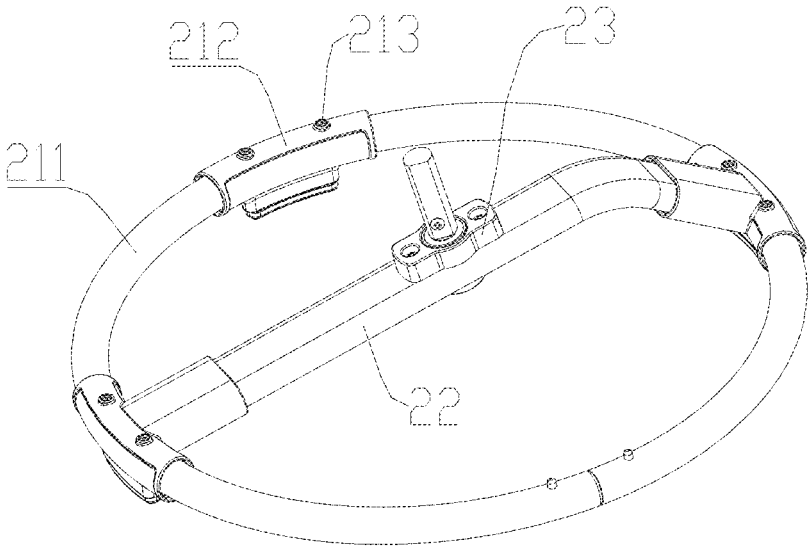
Figure 11:
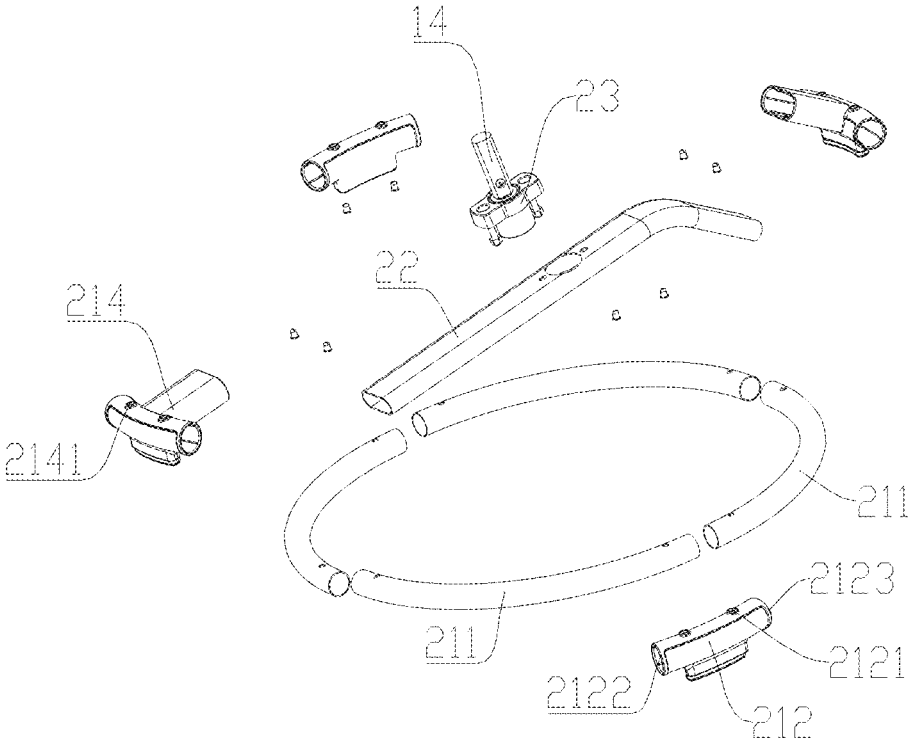
FIG. 11 is an exploded view of a base assembly of a children's swivel chair according to an example of the present disclosure.

With reference to FIGS. 1-11, a swivel chair 100 is disclosed in this example, and the swivel chair 100 includes a chassis assembly 1 and a base assembly 2, where the chassis assembly 1 is rotatably connected to the base assembly 2, the base assembly 2 is configured to support and fix the chassis assembly 1, and the chassis assembly 1 is configured for seating of a user, such that rotation around the base assembly 2 as a pivot is achieved. The children's swivel chair 100 not only has conventional seating functions, but also has rotation functions, thereby adding fun as a toy.

Specifically, the children's swivel chair 100 includes at least the chassis assembly 1, and the chassis assembly 1 includes a plurality of padding plates 11 that are spliced together, the plurality of padding plates 11 are spliced together to form a chassis structure concave in a middle, a bottom of the chassis structure is further provided with a support seat 12, and the support seat 12 rotationally supports the chassis structure on a carrier (such as a bottom surface, etc.). The plurality of padding plates 11 are spliced and assembled to form a roughly disc-like structure, and the adjacent padding plates 11 are spliced to form a relatively stable structure. Further, the chassis structure formed after splicing has detachable features, and the chassis structure can be quickly disassembled into various small components when needed, thereby facilitating storage and transport.

One of differences between the children's swivel chair 100 in this example and children's swivel chairs of the prior art lies in that the plurality of padding plates 11 of the chassis assembly 1 are detachably spliced, and can be quickly assembled or disassembled according to application scenarios or user needs, thereby facilitating storage and transport.

It can be understood that adjacent padding plates 11 can be assembled by means of detachable connections such as bolted connections or snap-fit connections.

In an example, the chassis assembly 1 further includes a clamp 13, a clamp groove 115 is formed at the bottom of the chassis structure close to an edge of the chassis, and the clamp 13 is snap-fitted into the clamp groove 115. A middle of the chassis assembly 1 in this example has a concave disc-like structure, and the clamp 13 is arranged at the bottom of the chassis structure close to the edge thereof, which can reinforce the padding plates 11 spliced together and enhances reliability and strength of the chassis assembly 1 formed after splicing. Further, the clamp 13 reinforces the padding plates 11, and the clamp 13 has advantages of simple and quick assembly and disassembly.

With reference to FIG. 6 again, in an example, each of the padding plates 11 is a fan-shaped structural member 111, a snap-fit slot 112 and a snap-fit bump 113 are arranged on adjacent edges of opposite outer sides of the padding plate 11 respectively, a snap-fit portion 114 is further arranged at an inner edge of the padding plate 11, and the snap-fit portion 114 is snap-fitted with the support seat 12; and the adjacent padding plates 11 are in inserted connection with the snap-fit bump 113 through the snap-fit slot 112. A structural design of the snap-fit slot 112 and the snap-fit bump 113 enables quick alignment and splicing of the padding plates 11, and also enhances a strength of connection after splicing.

With reference to FIG. 8 again, in an example, the snap-fit portion 114 includes a plug-in portion 1141 that radially extends from an inner edge of the padding plate 11 (close to a center of the chassis) and an annular groove 1142 located at a bottom of the plug-in portion 1141, the support seat 12 is provided with a disc-like connecting portion 1121, and the disc-like connecting portion 1121 is provided with a slot 121 corresponding to the plug-in portion 1141 and an annular wall 1122 corresponding to the annular groove 1142.

To simplify assembly and processing, in this example, when the plurality of padding plates 11 are spliced together, inner edges of the padding plates 11 collectively enclose a circular hole, and the circular hole is aligned and connected with the disc-like connecting portion 1121 of the support seat 12.

In an example, inner edges of the annular groove 1142 and the plug-in portion 1141 are parallel arc structures coaxially extending, that is, arcs of the two are coaxial and parallel.

Further, the support seat 12 is further provided with a rotating shaft 14, and the rotating shaft 14 is arranged parallel to an axis of the chassis structure. That is, the rotating shaft 14 supports rotation of the chassis assembly 1 in an axial direction thereof.

In an example, the support seat 12 has a conical structure, and the rotating shaft 14 is connected to an axial position of the conical structure. Specifically, a plurality of support plates axially extending are arranged at a bottom of the disc-like connecting portion 1121, and the support plates are triangular in shape, such that the support seat 12 is approximately conical in shape. A top end of the rotating shaft 14 is inserted into the support seat 12, a bottom end thereof extends out of the support seat 12, and a protruding portion of the bottom end is connected to the base assembly 2.

In an example, a stiffening rib 116 is further arranged on a bottom surface of each of the padding plates 11, and the stiffening rib 116 is arranged on a bottom surface of the chassis structure in a way of radially protruding to enhance supporting strength of the padding plate 11.

With reference to FIGS. 9-11 again, the children's swivel chair 100 further includes the base assembly 2 connected to the support seat 12, the base assembly 2 has a detachable structure, and the chassis assembly 1 is rotatably connected to the base assembly 2.

In an example, the base assembly 2 includes an annular seat 21 and a support arm 22 in bridge connection with the annular seat 21, both ends of the support arm 22 are connected to the annular seat 21 respectively, and the chassis assembly 1 is rotatably connected to the support arm 22.

In an example, the support arm 22 has an arch-shaped structure convex in a middle thereof. The annular seat 21 is circular ring-shaped. It can be understood that in other examples, the annular seat 21 can also have a closed ring structure shaped like an ellipse, polygon and the like. An outer contour of the annular seat 21 is not smaller than that of the chassis assembly 1, such that the base assembly 2 supports in a safer manner.

In an example, the chassis assembly 1 is rotatably connected to the base assembly 2 in an inclined state. For example, when the base assembly 2 is placed on a horizontal plane, the chassis assembly 1 is arranged at a certain angle of inclination relative to the horizontal plane, and is not parallel thereto, and the chassis assembly 1 arranged inclined rotates in an easier and more labor-saving manner.

In this example, the annular seat 21 includes: a plurality of arc-shaped tubes 211, and connectors that are configured to connect the adjacent arc-shaped tubes 211. The connectors are divided into two kinds: double-headed connectors 212 and triple-headed connectors 214, where the double-headed connectors 212 are configured to connect the adjacent arc-shaped tubes 211, and the triple-headed connectors 214 are configured to connect the adjacent arc-shaped tubes 211 and also the support arm 22.

Specifically, each of the double-headed connectors 212 is provided with a first connecting hole 2122 and a second connecting hole 2123 that are butt-jointed with the corresponding arc-shaped tube 211, the arc-shaped tube 211 is further provided with a telescopic column 213, each of the connectors is provided with a cylindrical hole 2121 (2141), and when the arc-shaped tube 211 is inserted into the first connecting hole 2122 or the second connecting hole 2123, the telescopic column 213 penetrates through the cylindrical hole 2121 (2141). Specifically, the telescopic column 213 is perpendicular to a length direction of the connecting hole inside the connector, when the base assembly 2 is assembled, the arc-shaped tube 211 is inserted into the first connecting hole 2122 or the second connecting hole 2123 until the telescopic column 213 penetrates through the cylindrical hole 2121 (2141), and in this case, the telescopic column 213 locks the connector and the arc-shaped tube 211 tightly. When the base assembly 2 is disassembled, the telescopic column 213 is pressed down to exit from the cylindrical hole 2121 (2141), and then the arc-shaped tube 211 is pulled away from the connector to disassemble.

With reference to FIG. 11 again, a middle of the support arm 22 is further provided with a connecting slot, a hinge seat 23 is arranged inside the connecting slot, and the rotating shaft 14 is rotatably connected to the hinge seat 23. Further, a bearing is further arranged between the rotating shaft 14 and the hinge seat 23 to reduce rotational resistance.

The chassis assembly of the children's swivel chair in this example is formed by splicing a plurality of structurally identical padding plates, and during transport or storage, each of the padding plates can be disassembled to reduce an overall volume and occupied space, thereby facilitating transport and storage. Further, the base assembly of the children's swivel chair is designed to have a detachable structure, which further enhances convenience of storage and transport.

The above examples are only intended to further illustrate the technical content of the present disclosure and facilitate understanding by the readers, but it does not mean that the embodiments of the present disclosure are only limited thereto. Any technical extension or recreation made based on the present disclosure falls within the scope of protection of the present disclosure. The scope of protection of the present disclosure shall be subject to the appended claims.

What is claimed is:

1. A children's swivel chair, comprising a chassis assembly, wherein the chassis assembly comprises a plurality of padding plates that are spliced together, the plurality of padding plates are spliced together to form a chassis structure concave in a middle, a bottom of the chassis structure is further provided with a support seat, and the support seat rotationally supports the chassis structure on a carrier, wherein the chassis assembly further comprises a clamp, a clamp groove is formed at a bottom of the chassis structure close to an edge thereof, and the clamp is snap-fitted into the clamp groove.

2. The children's swivel chair according to claim 1, wherein a respective snap-fit slot and a respective snap-fit bump are arranged on edges of opposite outer sides of each of the padding plates, a respective snap-fit portion is further arranged at an inner edge of each of the padding plates, and each of the snap-fit portions is snap-fitted with the support seat; and adjacent padding plates of the plurality of padding plates are in inserted connection with the snap-fit bump of a padding plate of the plurality of padding plates through the snap-fit slot of another padding plate of the plurality of padding plates.

3. The children's swivel chair according to claim 2, wherein each of the snap-fit portion comprises a respective plug-in portion and respective annular groove that radially extend from an inner edge of the respective padding plate, the support seat is provided with a disc-like connecting portion, and the disc-like connecting portion is provided with a slot corresponding to the plug-in portion of the respective snap-fit portion and an annular wall corresponding to the annular groove of the respective snap-fit portion.

4. The children's swivel chair according to claim 3, wherein inner edges of the annular groove and the plug-in portion of the respective snap-fit portion are parallel arc structures coaxially extending.

5. A children's swivel chair, comprising a chassis assembly, wherein the chassis assembly comprises a plurality of padding plates that are spliced together, the plurality of padding plates are spliced together to form a chassis structure concave in a middle, a bottom of the chassis structure is further provided with a support seat, and the support seat rotationally supports the chassis structure on a carrier, wherein the support seat is further provided with a rotating shaft, and the rotating shaft is arranged parallel to an axis of the chassis structure, and wherein a stiffening rib is further arranged on a bottom surface of each of the padding plates.

6. The children's swivel chair according to claim 5, wherein the support seat has a conical structure, and the rotating shaft is connected to an axial position of the conical structure.

7. The children's swivel chair according to claim 5, further comprising a base assembly connected to the support seat, the base assembly has a detachable structure, and the chassis assembly is rotatably connected to the base assembly.

8. A children's swivel chair, comprising a chassis assembly, wherein the chassis assembly comprises a plurality of padding plates that are spliced together, the plurality of padding plates are spliced together to form a chassis structure concave in a middle, a bottom of the chassis structure is further provided with a support seat, and the support seat rotationally supports the chassis structure on a carrier, wherein the support seat is further provided with a rotating shaft, and the rotating shaft is arranged parallel to an axis of the chassis structure, wherein the children's swivel chair further comprises a base assembly connected to the support seat, wherein the base assembly has a detachable structure, wherein the chassis assembly is rotatably connected to the base assembly, wherein the base assembly comprises an annular seat and a support arm in bridge connection with the annular seat, wherein both ends of the support arm are connected to the annular seat respectively, wherein the chassis assembly is rotatably connected to the support arm, wherein the annular seat comprises: a plurality of arc-shaped tubes, and connectors that are configured to connect adjacent arc-shaped tubes of the plurality of arc-shaped tubes, wherein each of the connectors is provided with a first connecting hole and a second connecting hole that are butt-jointed with the corresponding arc-shaped tube of the plurality of arc-shaped tubes, the corresponding arc-shaped tube is further provided with a telescopic column, each of the connectors is provided with a cylindrical hole, and when the arc-shaped tube is inserted into the first connecting hole or the second connecting hole, the telescopic column penetrates through the cylindrical hole.

9. The children's swivel chair according to claim 8, wherein the support arm has an arch-shaped structure convex in a middle thereof.

10. The children's swivel chair according to claim 7, wherein the chassis assembly is rotatably connected to the base assembly in an inclined state.

* * * * *